US007168558B2

(12) United States Patent
Harrelson

(10) Patent No.: US 7,168,558 B2
(45) Date of Patent: Jan. 30, 2007

(54) CARTON WITH AN INTERLOCKING DIVIDER PAD

(75) Inventor: Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 469 days.

(21) Appl. No.: 10/725,878

(22) Filed: Dec. 2, 2003

(65) Prior Publication Data

US 2005/0115843 A1 Jun. 2, 2005

(51) Int. Cl.
*B65D 5/49* (2006.01)

(52) U.S. Cl. ..... 206/170; 206/427; 229/120.32; 229/120.38

(58) Field of Classification Search ..... 229/120.32, 229/120.38, 121, 122, 122.1, 204–242; 206/427, 206/429–430, 434; 221/303, 305, 306, 309
See application file for complete search history.

(56) References Cited

U.S. PATENT DOCUMENTS

| | | | | |
|---|---|---|---|---|
| 1,896,326 | A | | 2/1933 | Northway-Ley |
| 1,898,646 | A | | 2/1933 | Taylor |
| 2,875,942 | A | | 3/1959 | Wilson |
| 3,822,785 | A | | 7/1974 | Getz et al. |
| 3,937,326 | A | | 2/1976 | Schick |
| 4,120,443 | A | | 10/1978 | Gardner et al. |
| 4,421,229 | A | * | 12/1983 | Pan et al. ..... 206/750 |
| 4,577,799 | A | | 3/1986 | Oliff |
| 5,415,344 | A | | 5/1995 | Harrelson |

(Continued)

FOREIGN PATENT DOCUMENTS

| | | |
|---|---|---|
| CH | 263456 | 8/1949 |

(Continued)

*Primary Examiner*—Mickey Yu
*Assistant Examiner*—Jerrold Johnson
(74) *Attorney, Agent, or Firm*—Womble Carlyle Sandridge & Rice, PLLC

(57) ABSTRACT

A carton for carrying containers, such as cans, or other articles in two layers which has an interlocking separator pad between the two layers is provided. This separator pad has at least one leading flap which extends through slits provided on the side end flaps on the interlocking end of the carton so that the leading flap is folded up or down and the bottom end flap and top end flap folded and glued to the side end flaps of the carton. This pad may have a trailing flap that is folded up or down on the other end of the carton to assist in holding the pad in position. This pad may have a leading flap on both ends for interlocking both ends of the carton to the interlocking separator pad. This carton may be provided with a dispenser in the side panel near the end on which the carton is rested to dispense cans. This dispenser may extend into the top panel and the bottom panel so that the ends of the cans can be grasped for easy removal. A dispenser may also be provided by forming tears line in the bottom end flap and top end flap that turn and extend along the fold lines between the bottom panel and the top panel until they reach the side panel on which the carton rests for dispensing cans from this dispenser. When this dispenser is used the trailing flap needs to be constructed so it does not extend into the opening formed when the dispenser is opened.

43 Claims, 6 Drawing Sheets

U.S. PATENT DOCUMENTS

| | | | |
|---|---|---|---|
| 5,427,242 | A | 6/1995 | Oliff et al. |
| 5,437,143 | A | 8/1995 | Culpepper et al. |
| 5,518,111 | A | 5/1996 | Stout |
| 5,669,500 | A | 9/1997 | Sutherland |
| 5,682,984 | A | 11/1997 | Howell et al. |
| 5,772,030 | A | 6/1998 | Baxter |
| 5,826,783 | A | 10/1998 | Stout |
| 5,868,252 | A | 2/1999 | Oliff |
| 5,938,109 | A | 8/1999 | Sainz et al. |
| 6,991,107 | B2 | 1/2006 | Harrelson |
| 2005/0167292 | A1 | 8/2005 | Sutherland |

FOREIGN PATENT DOCUMENTS

| | | | |
|---|---|---|---|
| DE | 88 14 144.6 | | 1/1989 |
| DE | G 91 11 941.3 | | 2/1992 |
| FR | 1427897 | | 4/1966 |
| FR | 1489087 | | 7/1967 |
| FR | 1.497.652 | | 10/1967 |
| FR | 2.223.985 | | 10/1974 |
| GB | 434145 | | 8/1935 |
| GB | 2 198 709 | A | 6/1988 |
| GB | 2 323 352 | | 9/1998 |
| JP | 7-125745 | | 5/1995 |
| JP | 9-142449 | | 6/1997 |
| JP | 11-130049 | | 5/1999 |
| JP | 2000-85754 | | 3/2000 |
| WO | WO 96/29261 | | 9/1996 |
| WO | WO 02/030764 | A4 | 4/2002 |

* cited by examiner

CARTON WITH AN INTERLOCKING DIVIDER PAD

RELATED APPLICATIONS

The present application is related to U.S. application Ser. Nos. 10/725,878, 10/770,301, and 10/770,756.

BACKGROUND OF THE INVENTION

1. Field of the Invention

The present invention relates generally to a carton for carrying cylindrical containers or other types of articles in two layers, with each layer having two or more rows. An interlocking divider pad, or separator pad, is provided which interlocks with the side end flaps on at least one end of the carton. This carton may have a dispenser in the end wall or in a side panel to permit easy access and removal of the containers in the carton.

2. Background

Fully enclosed cartons that are capable of carrying cans have been used in the past that have a feature for dispensing the cans one at a time. Many of these dispensers do not work in a satisfactory fashion when the cans are carried in two layers. It is desirable to carry cans of certain products in two layers, especially when the can size is small. It would be desirable to have a dispenser that would permit the dispensing of cans from each layer in a carton that is contains two layers of cans. It would be desirable to have a divider or separator pad separating the two layers of cans in order for the dispenser on the carton to work properly. Otherwise, the cans in one layer could interfere with the dispensing of cans in the other layer. It would also be desirable to have a divider, or separator, pad that would remain in place during the dispensing of all cans in the carton. It would also be desirable to have a divider, or separator, pad that would work with the dispenser in the side panel of the a carton and also with a dispenser in the end wall.

SUMMARY OF THE INVENTION

Briefly described, the present invention relates to a fully enclosed carton that is capable of carrying two layers of cans or other articles which has an interlocking separator, or divider, pad separating the two layers of cans or other articles. The carton has a bottom panel, top panel and foldably attached side panels. Preferably each end of the carton is closed by a pair of side end flaps to which a top end flap and bottom end flap are secured, preferably by glue. At least one end of the carton is an interlocking end. The interlocking end of the carton has a slit or notch in each side end flap. The separator, or divider, pad has a leading flap foldably attached to the pad which is extended through the slit in each side end flap on the interlocking end of the carton and folded up or down. The top and bottom end flaps are then closed interlocking the divider pad into position between the two layers of cans or other articles. The other end of the divider pad may have a trailing flap that is foldably attached to the pad and folded up or down inside the carton. This trailing flap preferably has the height that is approximately equal to the height of the cans or articles being contained. This means that the outer edge of the trailing flap would be close to either the top panel or bottom panel of the carton and would aid in holding the divider pad in proper position during the removal of the cans or other articles from each layer in the carton.

Each end of the carton can be made to be an interlocking end with a divider pad extending through slits in the side end flaps on each end of the carton, with a divider pad having a leading flap on each end that is folded up or down outside of the side end flaps and interlocked into position by the top and bottom end flaps overlapping the leading flap.

The ends of this carton can be held together by gluing the top end flap and bottom end flap on each end of the carton to the side end flaps. The interlocking separator pad is held in position by interlocking with the side end flaps on at least one end of a carton and need not be glued to be held in proper position. While it is preferable to glue the ends of the carton, other means, such as stapling, can be used. The carton and interlocking separator pad of this invention is used to carry two layers of cans or other articles, with each layer having two or more rows. Cans are arranged in a group with the interlocking separator pad placed on top of the group of cans and another group of cans is stacked on top of the interlocking separator pad. The two layers of cans are then pushed into the carton and the leading flap on the interlocking separator pad is pushed through the slits on the side end flaps and turned up or down and held in position by the bottom end flap and top end flap on that end of the carton. Preferably, a trailing flap is foldably attached to the interlocking separator pad. When this trailing flap is pushed into the carton, both layers of cans are pushed into the carton.

This carton may have a dispenser for dispensing cans from each layer one at a time. One type of dispenser may be located in the side panel for dispensing cans from the carton when the carton is resting on the end adjacent to the dispenser. This dispenser can be formed by two parallel tear lines forming a dispenser flap in the side panel with these parallel tear line extending across the side panel and into the adjoining top and bottom panels where the bottom and top tear lines are interconnected. These tear lines are spaced apart by a distance approximately equal to the diameter of a can to be carried in the carton. A tear line may interconnect the top and bottom tear lines in the side panel and have a finger flap foldably attached to each side of the tear line which essentially divides the flap into two portions. These finger flaps can be pushed in to enable a person to grasp the two portions of the flap and pull them open forming the dispenser opening for dispensing cans from each layer. The bottom tear line for forming the dispenser flap is spaced close enough to the end of the carton upon which it rests during dispensing to prevent cans from rolling out of the opening. This bottom tear line should not be placed so far from this end of the carton as to make it difficult to remove cans immediately adjacent this end of the carton. Preferably the tear lines interconnecting the top and bottom tear lines in the bottom panel and in the top panel are curved like the cans are curved to permit the easy grasping of the end of a can when the dispenser flap has been removed. For most cans this bottom tear line need only be located approximately one inch from the end of the carton on which it is resting during dispensing. A tear line may be provided in the top panel and in the bottom panel between the bottom tear line and the end of the carton on which the carton rests when cans are being dispensed to form a ledge between the bottom tear line and the end of the carton. If these tear lines between the bottom tear line and the end of the carton are torn open, and the ledge moved forward, it will provide less resistance to the removal of cans from the dispenser opening. Having a dispenser opening in a side panel of the carton for dispensing cans while the carton rests upon its end adjacent the dispenser opening provides a large display area in the side panel above the dispenser for advertising to the consumer.

Alternatively, a dispenser can be placed in an end of the carton for dispensing cans from each layer of cans while a carton is resting on a side panel. When a dispenser is placed in the end of the carton, it is preferably placed on the end where the trailing flap of the interlocking divider pad is located. This trailing flap needs to be constructed so that it does not extend into the opening formed when the dispenser flap is opened so as not to interfere with the removal of cans from both layers.

A dispenser flap is provided in the end of the carton by extending a tear line through the bottom end flap to the bottom panel and turning the tear line to run along the fold line between the bottom panel and bottom end flap to the side panel upon which the carton is designed to rest when dispensing containers. In a similar fashion a tear line extends through the top end flap to the top panel and along the fold line between the top panel and the top end flap to the side panel on which the carton rests when dispensing cans. When the dispensing end of the carton is closed the tear line through the bottom end flap and the tear line through the top end flap meet each other. These tear lines are located a distance from the bottom panel of the carton on which it rests during dispensing so as to prevent the cans in each layer from automatically rolling out of the carton through the dispenser opening formed by removing the dispenser flap.

A dispenser can be formed in an end of the carton when both ends of the interlocking separator pad are interlocked with the side end flaps on both ends of the carton. In this case it will be necessary to construct the leading flap near the dispenser flap so it does not interfere with the dispensing of cans through the dispenser opening formed by the removal of the dispenser flap.

For easy opening, punch in finger flaps can be located along the tear lines so a person can commence tearing the dispenser flap open. Preferably, the tear lines in the bottom end flap and top end flap are curved downwardly towards each other until they meet to provide the optimum amount of resistance to cans rolling out of the carton through the dispenser opening. The distance from the tear line in the bottom end flap and top end flap to the side panel of the carton upon which it rests during dispensing is significantly less than the diameter of cans to be contained in the carton. This carton may have a carrying handle formed by two fingers holes in the top panel.

These cartons may be constructed by gluing, taping, stapling and the like. A carton may be provided with both types of dispensers described supra. A carton may have two dispensers of the same type. Preferably, only one dispenser is used in a carton.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

The present invention is primarily for use with cans of the type used to contain meat products, vegetables and fish. The carton of this invention is primarily useful for cans that are stacked in the carton in two layers with two of more rows in each layer. These cans typically only have a height of two or three inches, and typically these cans are stacked in a carton in two layers of six cans in each layer.

Figure 1:
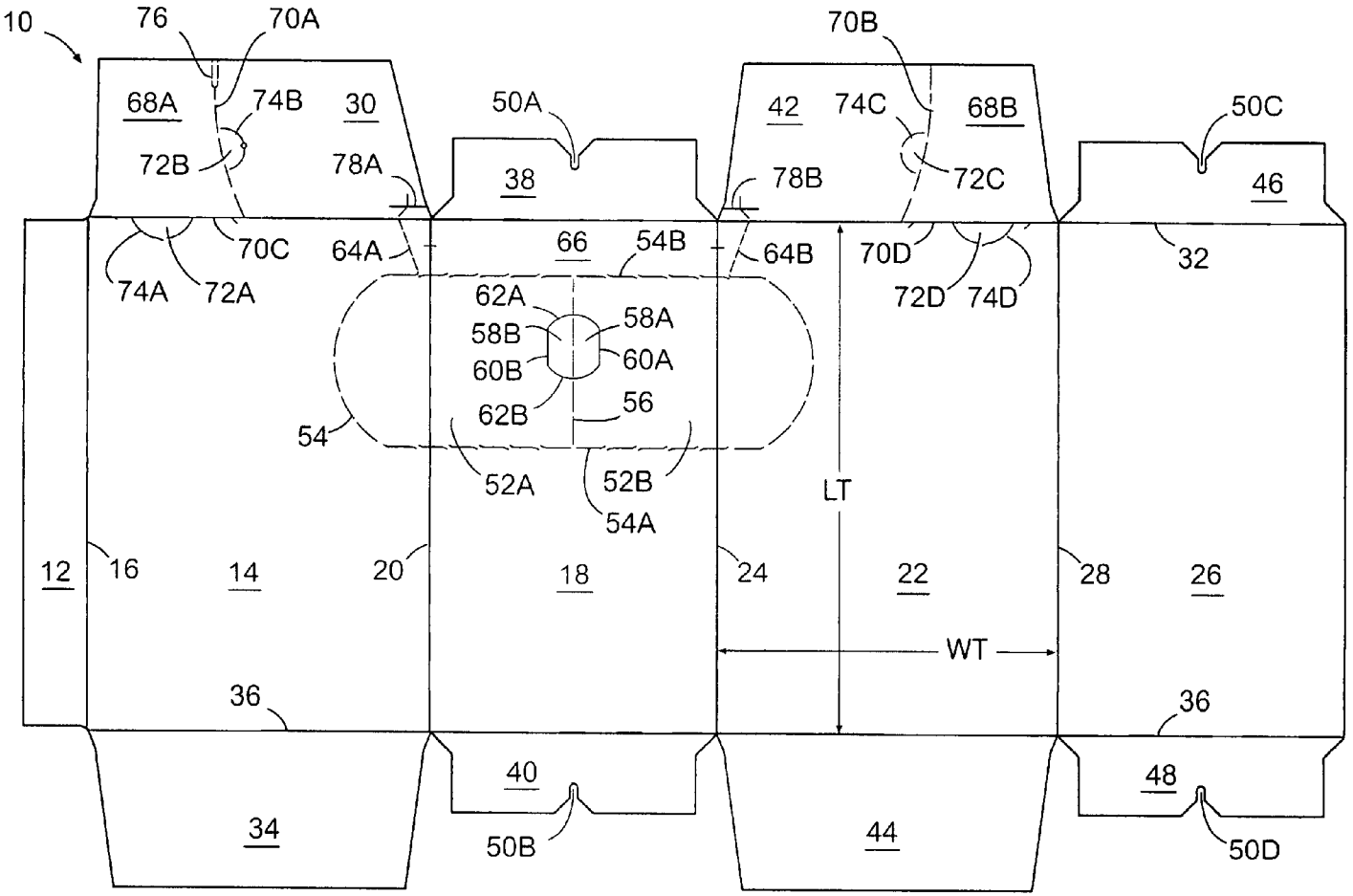
FIG. 1 is a plan view of a blank of which a carton according to one embodiment of this invention is constructed.
Figure 1A:
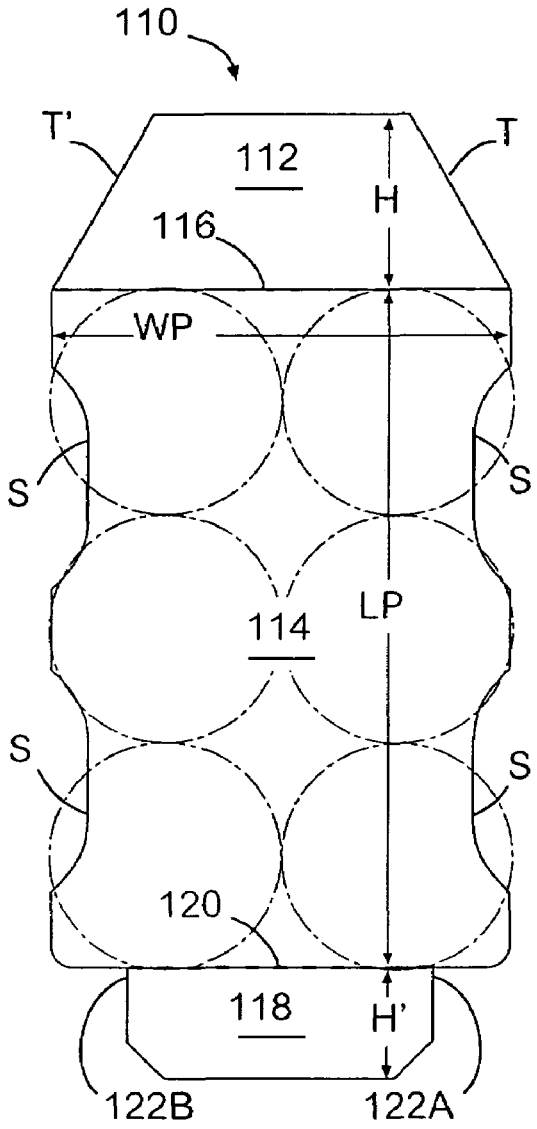
FIG. 1A is a plan view for an interlocking separator pad according to one embodiment of this invention.
Figure 1B:
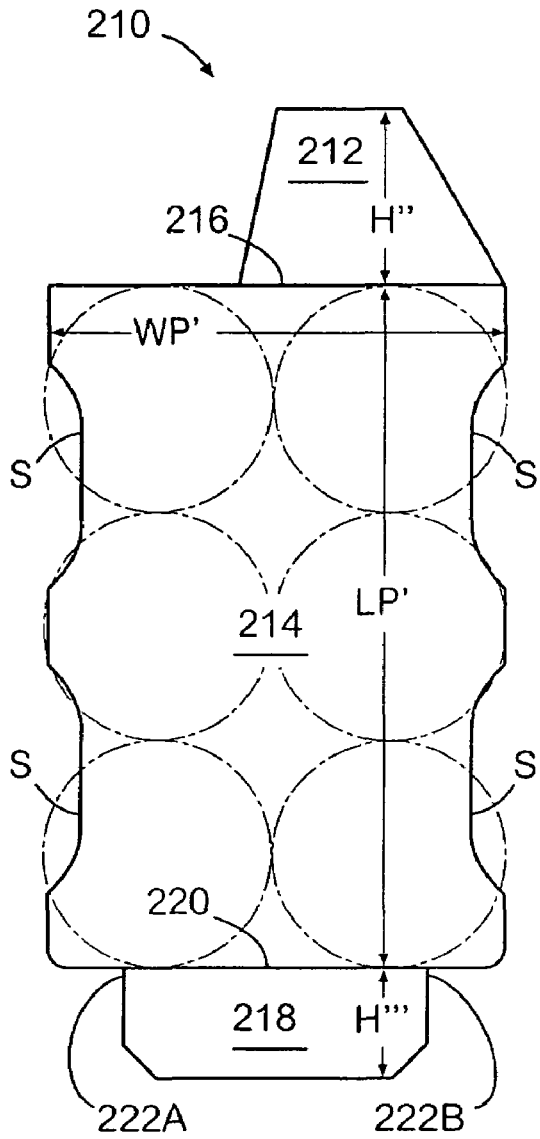
FIG. 1B is a plan view of an interlocking separator pad of another embodiment of this invention.

As illustrated in FIG. 1, the blank 10 for forming the carton of this invention is formed from a foldable sheet of material, such as paperboard. The blanks 110 and 210 for forming the interlocking separator pad is also formed from a foldable sheet of material, such as paperboard, as illustrated in FIGS. 1A and 1B.

The blank 10 for forming the carton of this invention has a glue flap 12 which is attached to bottom panel 14 by fold line 16 and interconnected to side panel 18 by fold line 20. Side panel 18 is connected to top panel 22 by fold line 24, and interconnected to opposite side panel 26 by fold line 28.

Bottom panel 14 is connected to bottom end flap 30 by fold line 32 and connected to opposite bottom end flap 34 by fold line 36. Side panel 18 is connected to side end flap 38 by fold line 32 and to opposite side end flap 40 by fold line 36. Top panel 22 is connected to top end flap 42 by fold line 32 and to opposite top end flap 44 by fold line 36. Opposite side panel 26 is connected to side end flap 46 by fold line 32 and to opposite side end flap 48 by fold line 36.

Side end flaps 38 and 46 on one end of the carton may have slits 50A and 50C in their ends which are remote from the side panels 18 and 26, respectively, to which they are attached for receiving the interlocking separator pad, which will be discussed infra. Slits 50B and 50D may be provided in side end flaps 40 and 48, respectively, for interlocking the separator pad on both ends of the carton. These slits 50A–D are located in the side end flaps at a distance from the bottom panel 14 when the carton is formed that is approximately equal to the height of the cans to be contained in the bottom layer which will be adjacent to the bottom panel. In other words, these slits are located so the interlocking separator pad can be placed between the two layer of cans.

Figure 7:
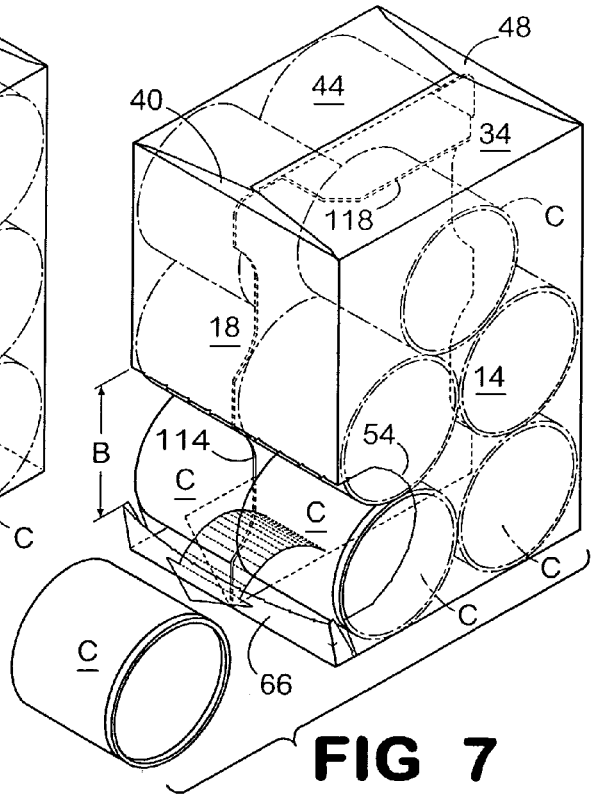
FIG. 7 is a perspective view of the side of the carton with the side dispenser flap having been removed exposing the dispenser opening.

Two different types of dispenser openings for dispensing cans are provided for the blank illustrated in FIG. 1. One of these dispenser openings is dispenser opening B in a side panel as best illustrated in FIG. 7. The dispenser opening may be in the end of the carton as illustrated by dispenser opening D in FIG. 9. The dispenser opening B (as shown in FIG. 7) may be made available by providing two side dispenser flaps 52A–B in the side panel 18 that extend into the bottom panel 14 and top panel 22 as shown in FIG. 1. These side dispenser flaps 52A–B are formed by tear lines 54A and 54B which are parallel to each other in side panel 18. These two side dispensers flaps 52A and 52B can be formed as a single dispenser flap, but for ease of opening it is preferred to have two dispenser flaps 52A and 52B. Finger flaps 58A and 58B may be provided along tear line 56 which separates side dispenser flaps 52A and 52B to assist in opening these flaps. Finger flap 58A is attached to side dispenser flap 52B by fold line 60A and finger flap 58B is attached to side dispenser flap 52A by fold line 60B. Finger flaps 58A and 58B can be formed by providing cuts 62A and 62B.

To facilitate removing cans from the dispenser opening B (as shown in FIG. 7) after the side dispenser flaps 52A and 52B have been removed, tear lines 64A and 64B may be provided to permit the movement of the dispenser ledge 66 formed between bottom tear line 54B and fold line 32 to ease the removal of cans through the dispenser opening B.

Figure 9:
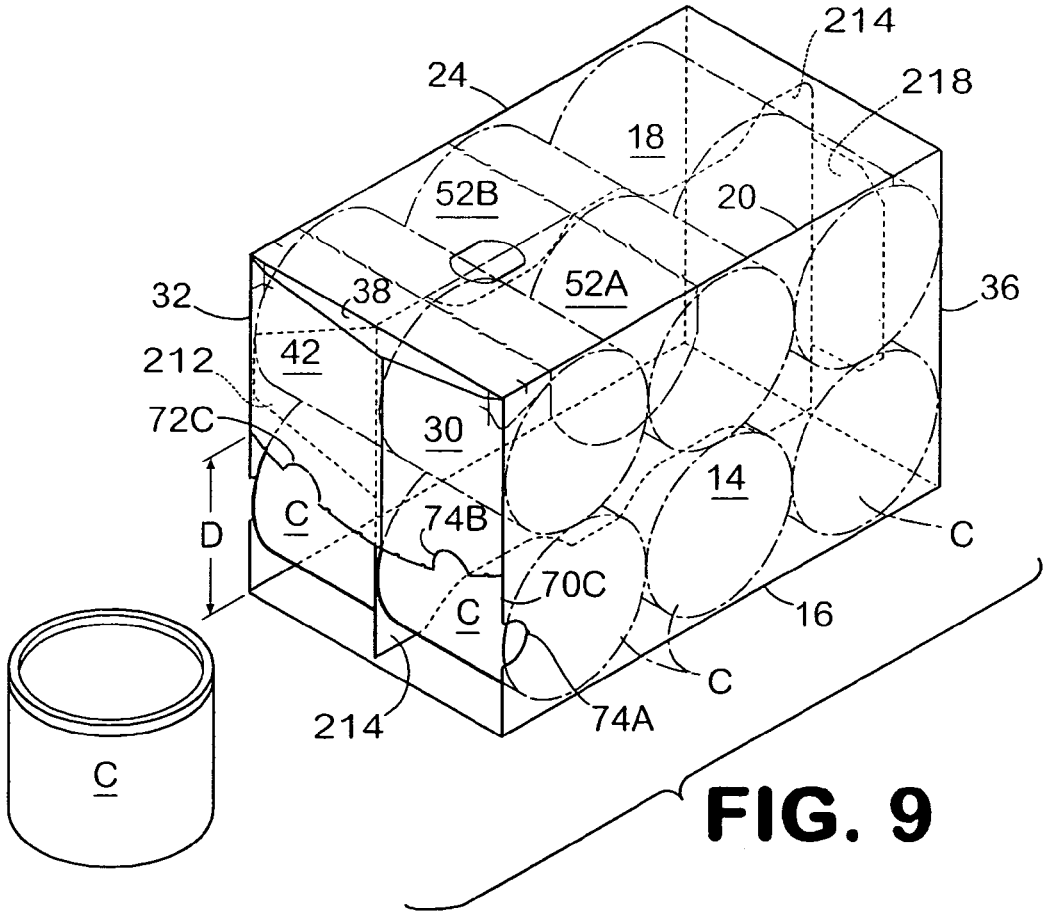
FIG. 9 is a perspective view of the carton loaded with can of FIG. 8 in which the dispenser flap has been removed exposing the dispenser opening allowing the dispensing of cans.

A dispenser opening D may be provided in the end of the carton as illustrated in FIG. 9. End dispenser flap 68A is formed by providing curved tear line 70A that extends from the remote end of bottom end flap 30 to bottom panel 14 and then turns and is coextensive with fold line 32 as tear line 70C until it reaches fold line 16. End dispenser flap 68B is formed in top end flap 42 by curved tear line 70B which extends from the end of top end flap 42 to top panel 22 and the turns and is coextensive with fold line 32 as tear line 70D until it reaches fold line 28. Finger opening flaps 72A–D may be provided for assistance in starting the opening of end dispenser flaps 68A and 68B. These finger opening flaps 72A–D are provided adjacent to tear lines 70A–D. These finger opening flaps 72A–D may easily be pushed inward because of their provision with tear or cut lines 74A–D respectively. A starting slit 76 may be provided to start the tearing of tear line 70A.

Normally a carton formed from the blank of FIG. 1 only has provision for dispenser opening B or D, and not both. Of course, a carton could be constructed that has provision for two dispenser openings B or two dispenser openings D.

A blank 110 for forming an interlocking separator pad for the carton formed from blank 10 is illustrated in FIG. 1A primarily for use when dispenser opening B (FIG. 7) is to be provided. This blank 110 has a trailing flap 112 which is foldably attached to separator pad 114 by fold line 116 and foldable attached to leading flap 118 by fold line 120. Leading flap 118 has locking edges 122A and 122B. The width WP of the separator pad 114 must be at least slightly less than the width WT of the top panel 22 between fold line 24 and 28 of the carton formed from the blank 10 of FIG. 1. The length LP of the separator pad 114 must be approximately the same length as the length LT of the carton as illustrated in blank 10. The height H of the trailing flap 112 must not be greater than the height of a can to be contained in the carton. The height H' of leading flap 118 must also be less than the height of a can. The trailing flap 112 may have inwardly tapering edges T to save material and to facilitate folding trailing flap 112 along fold line 116. The separator pad 114 may have inward scallops S to ease the insertion of separator pad 114 into the carton.

A variation of the blank 110 is illustrated in FIG. 1B by blank 210 for forming interlocking separator pad 214 for use with a dispenser opening D illustrated in FIG. 9. This blank 210 is identical to the blank 110 except that the trailing flap 212 is basically cut in half The blank 210 is designed to be used as an interlocking separator pad 214 in conjunction with dispenser opening D' (FIG. 9) so that the trailing flap does not prevent the removal of cans from the carton through the dispenser opening D'. The blank 210 has a half trailing flap 212 connected to separator pad 214 by fold line 216 and in turn connected to leading flap 218 by fold line 220. The separator pad 214 may have scalloped indentations S along its edge. The height H" of the trailing flap 212 is approximately the height, or less, of a can to be contained in the carton. The height H"' of the leading flap 218 may be significantly less than the height of a can to be contained in the carton. The leading flap 218 has leading flap locking ledges 222A and 222B. The length LP' of the separator pad 214 is approximately the length LT of the top panel 22 of the carton. The width WP' of the separator pad 214 is slightly less than the width WT of the top panel 22 of the carton.

Figure 2:
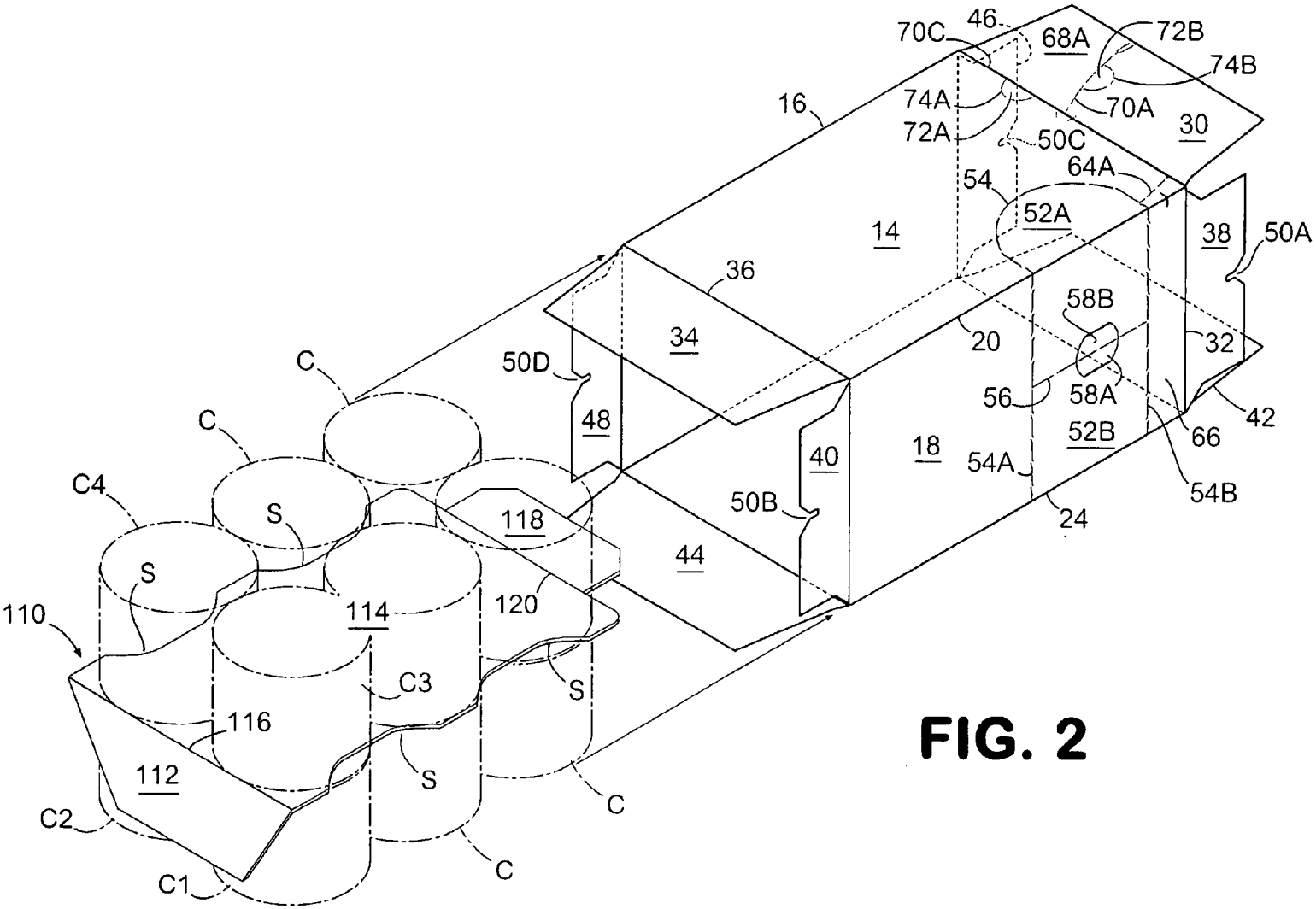
FIG. 2 is a perspective view of a carton formed from the blank of FIG. 1 and the separator pad of FIG. 1A that has been placed between two layers of cans for loading into the carton.
Figure 3:
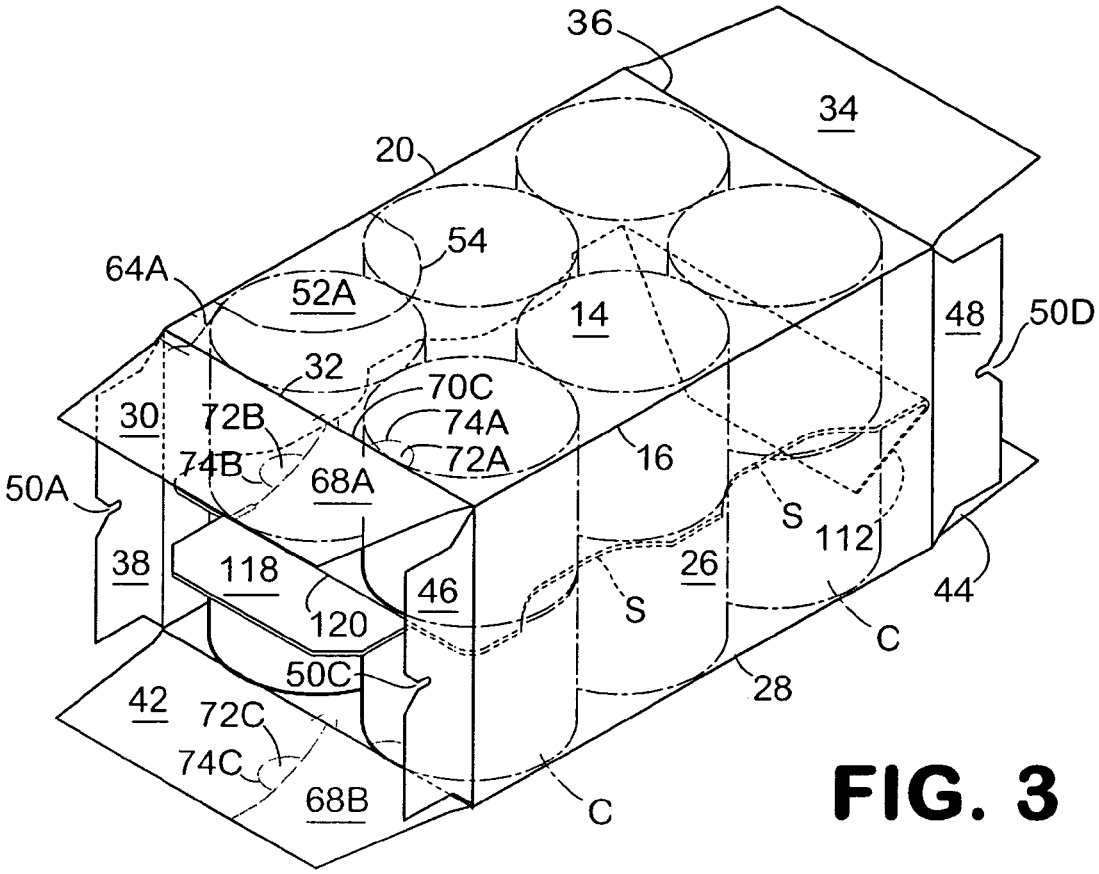
FIG. 3 is perspective view of the carton taken from the interlocking end, with the carton loaded with two layers of cans with a separator pad between the layers.
Figure 4:
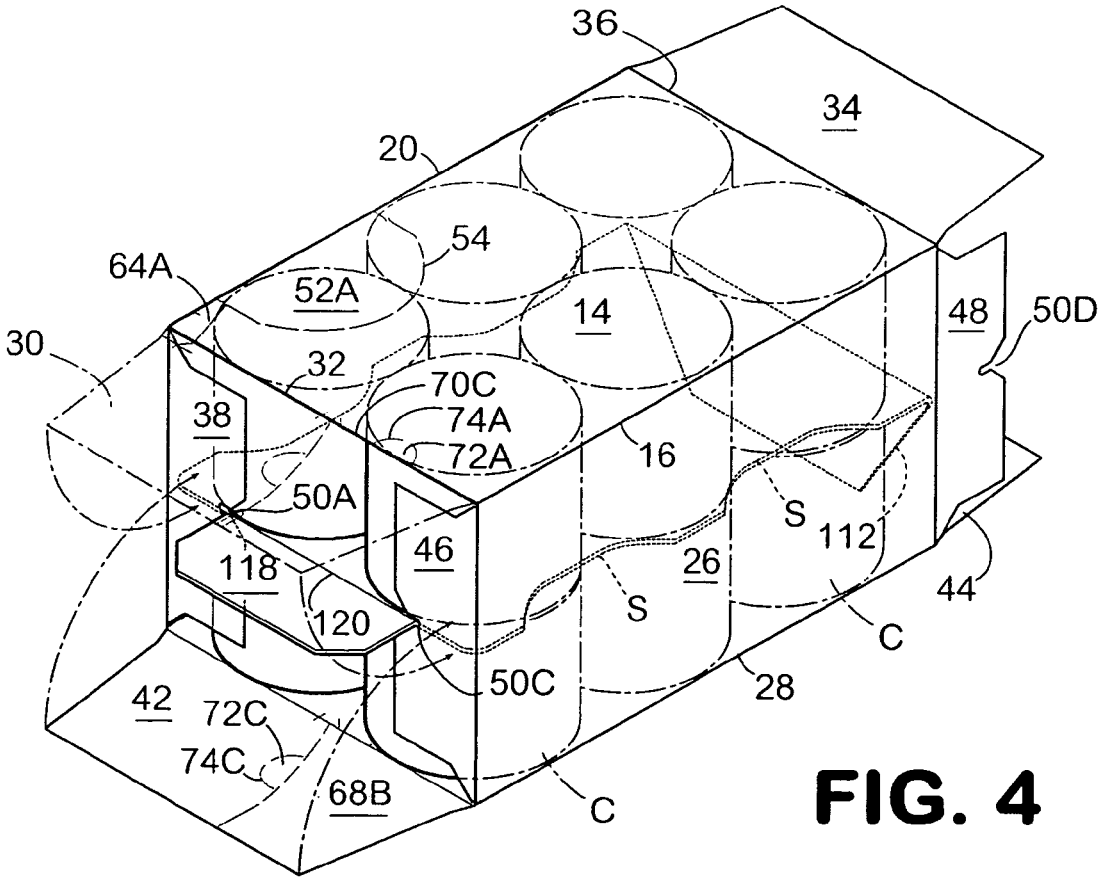
FIG. 4 is a perspective view of the carton loaded with cans of FIG. 3 which shows the two slits of side end flaps of the carton engaged with the locking edges of the leading flap of the separator pad.
Figure 5:
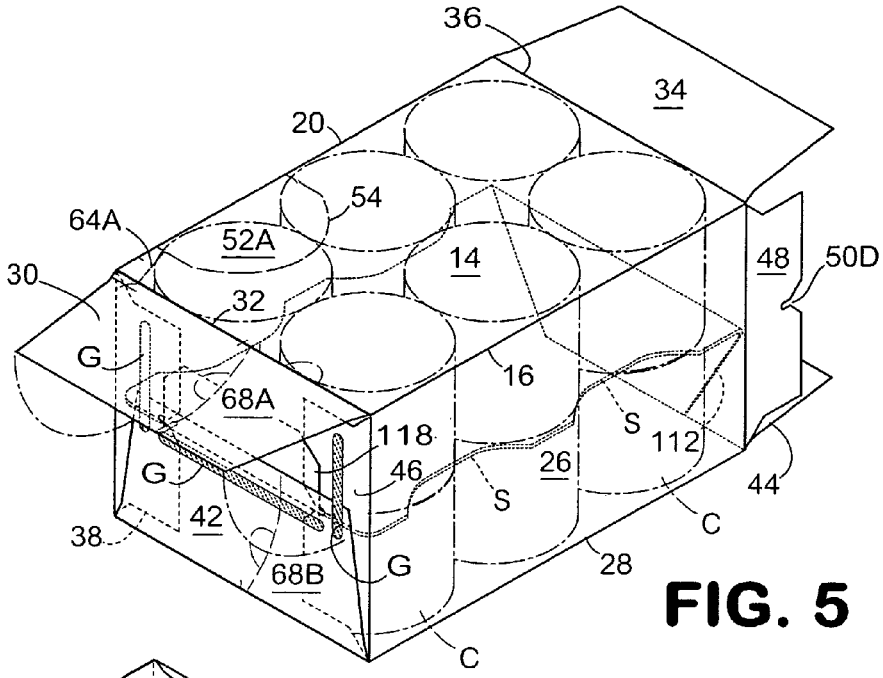
FIG. 5 is a perspective view of the carton of FIG. 4 loaded with cans with the bottom end flap closed over the side end flaps of the carton.
Figure 6:
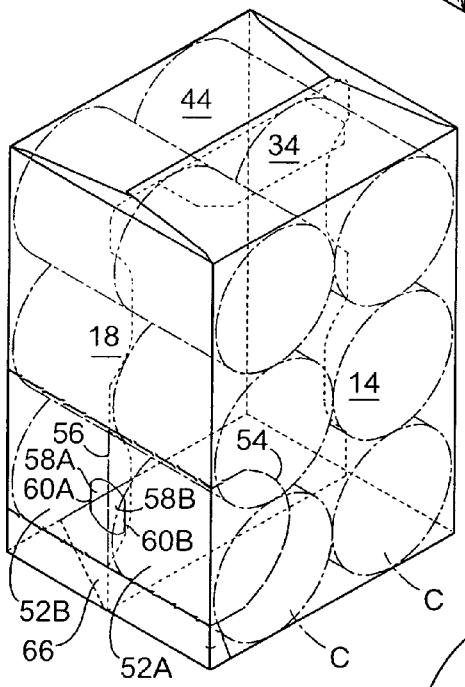
FIG. 6 is a perspective view of the closed carton of FIG. 5 which shows the carton resting on its end near the side dispenser.

The blank 10 of this embodiment is formed into a carton sleeve by gluing glue flap 12 to opposite side panel 26 to form a sleeve as illustrated in FIG. 2. The blank 110 for the interlocking separator pad 114 is placed on top of two rows of cans, as illustrated by C1 and C2, in one layer in FIG. 2. The carton sleeve in FIG. 2 is shown with the bottom panel 14 in the top position. Because the bottom panel 14 and top panel 22 are identical, the carton sleeve can also be loaded with the top panel 22 in the top position. It should be pointed out that it is possible to have more than two rows of cans in each layer in the carton. In FIG. 2 a second layer of two rows of cans represented by cans C3 and C4 is placed on top of separator pad 114. The two layers of cans and the separator pad 114 between them is then pushed into the carton sleeve by pushing trailing flap 112 until both layers of cans are inside the carton sleeve as shown in FIG. 3. FIG. 3 is a perspective view of the other end of the carton showing leading flap 118 projecting beyond the end of the carton. This end of the carton is closed by folding side end flaps 38 and 46 into the closed position as shown in FIG. 4. As the side end flaps 38 and 46 are closed, slits 50A and 50C slide along the edges of leading flap 118. Leading flap 118 is then pushed upward until it lies against side end flaps 38 and 46. The leading flap 118 is held in the interlocked position by locking edges 122A and 122B which hold the separator pad 114 firmly against the inside of side end flaps 38 and 40 in an interlocked position. It will be realized that leading flap 118 could be folded down until it is in contact with side end flaps 38 and 46. Once the leading flap has been folded up, top end flap 42 can be folded up and glued to side end flaps 30 and 46 along glue line G as shown in FIG. 5. It will be appreciated that the top end flap 42 can be folded up which would push the leading flap 118 into the locked position. The bottom end flap 30 can then be folded down overlapping top end flap 42 and glued to top end flap 42 and side end flaps 38 and 46. The leading flap 118 is held in the interlocked position by locking edges 122A and 122B interlocking with side end flaps 38 and 46 through slits 50A and 50C, and need not be glued into position. Side end flaps 40 and 48 may be closed with a trailing flap 112 in the perpendicular position inside the carton sleeve. Top end flap 44 can be folded up in an overlapping position and bottom end flap 34 can be folded down and glued to side end flaps 40 and 48. Top end flap 44 can overlap bottom end flap 34 slightly and be glued to bottom end flap 34. The trailing flap 112 is held in the vertical position inside the carton between side end flaps 40 and 48 and the adjoining two rows of cans in the carton. The height H of the trailing flap 112 must not be greater than the height of a can contained in the carton. Preferably the height H of trailing flap 112 is slightly less than the height of a can so that separator pad 114 will be held in the proper position between the two layers of cans while cans are being removed through a dispenser opening in the carton. The height H' of the leading flap 118 must be less than the height of a can to be contained in the carton. The height H' of the leading flap 118 can be considerable less than the height of the can as the function of the leading flap is for the locking edges 122A and 122B to interlock with side end flaps 38 and 46 through slits 50A and 50C.

Separator pad 114 should only be used with a carton constructed from the blank 10 which provides dispenser opening B as shown in FIG. 7. If the carton has tear lines for forming dispenser opening D as shown in FIG. 9 the trailing flap 112 will interfere with the removal of cans from dispenser opening D if the trailing flap 112 is adjacent the dispenser opening D. If the leading flap 118 is adjacent the dispenser opening D, it will also interfere with the removal of cans from dispenser opening D.

Figure 8:
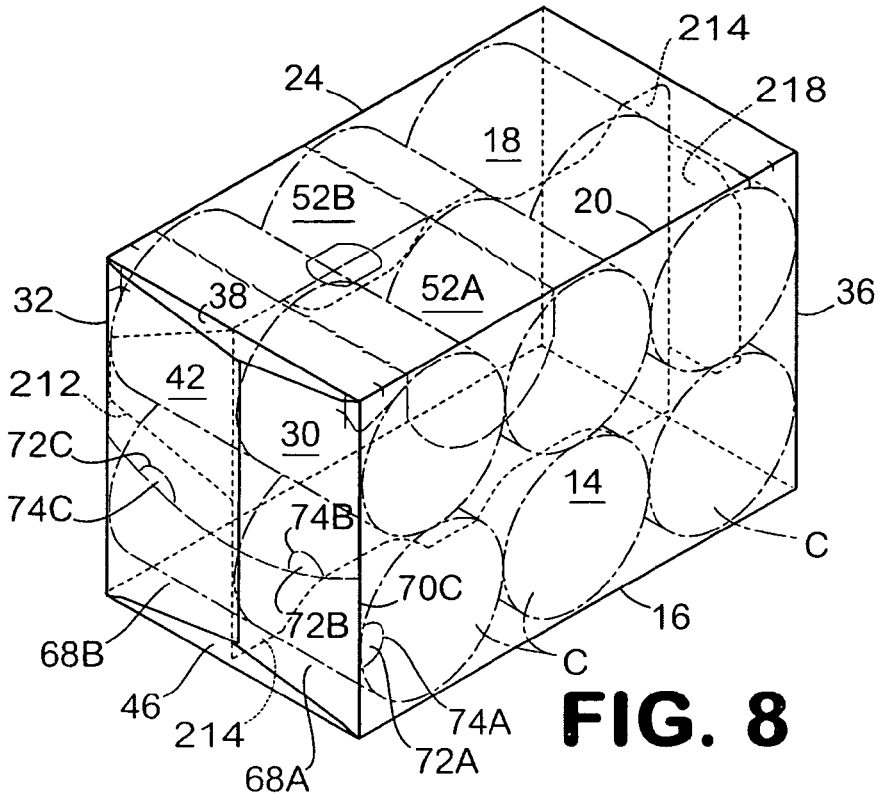
FIG. 8 is a perspective view of a carton made from the blank of FIG. 1 loaded with cans with the separator pad of FIG. 1B showing the dispenser flap in the end of the carton.

Both ends of the blank for the separator pad 114 can be interlocked with the side end flaps by replacing trailing flap 112 with a leading flap similar to a leading flap 118. In this case the leading flap that replaces trailing flap 112 will need to remain in the horizontal position as the cans pushed into the carton sleeve. A push mechanism may be needed on the packaging machine to accomplish this objective. The leading flap that replaces trailing flap 112 would extend through slits 50B and 50D on side end flaps 40 and 48 respectively when they are closed as shown in FIG. 2. This leading flap can then be either pushed up or down and the top end flap 44 and bottom end flap 34 closed and glued to the side end flaps 40 and 48. This will result in a carton with the interlocking separator pad 114 being interlocked on both ends of the carton In the case of a carton that is designed to use dispenser opening D as shown in FIG. 9, the blank 210 shown in FIG. 1B is used for forming the interlocking separator pad. This blank 210 is placed on a layer of containers like blank 110 shown in FIG. 2 except that the cans are pushed through the carton sleeve from the other end. This leading flap 218 is pushed through the carton sleeve until it projects beyond the end of the carton sleeve. Side end flaps 40 and 48 are closed which results in sliding slits 50B and 50D along the edges of leading flap 218. Leading flap 218 is then either folded up or down and trapped between side end flaps 40 and 48 and bottom end flap 34 and top end flap 44 which are glued to side end flaps 40 and 48. The top end flap 44 may overlap bottom end flap 34 and be glued to this flap. The half trailing flap 212 is folded into the vertical position on the inside of the carton next to side end flap 38 adjacent to side panel 18 as shown in FIGS. 8 and 9 so it does not interfere with cans being pulled out of dispenser opening D as shown in FIG. 9.

Leading flap 218 is interlocked along locking edges 222A and 222B with slits 50B and 50D in side end flaps 40 and 48. This interlocking keeps the separator pad 214 in proper position in respect to the cans even when some cans have been removed. The height H" of half trailing flap 212 should be slightly less than the height cans in the carton to ensure that the separator 214 remains in proper position during the removal of cans from the carton through dispenser opening D as shown in FIG. 9.

It is important that the length LP of separator pad 114 be approximately the same length LT as the top panel 22 of the carton. This is also true of the length LP' of separator pad 214. The width WP of separator pad 114 and the width WP' of separator pad 214 should be slightly less than the width WT of top panel 22 of the carton.

In the embodiment of the carton that has dispenser opening B as shown in FIG. 7, the side dispenser flaps 52A and 52B can be easily opened by pushing in fingers flaps 58A and 58B and tearing side dispensing flaps 52A and B along tear lines 54A and 54B and removing each flap. A can C be removed from each layer of cans as shown in FIG. 7. The distance between top tear line 54A and bottom tear line 54B should be approximately equal to the diameter of a can. Preferably the distance between tear line 54B and fold line 32 is approximately one inch for many sizes of cans. The distance between bottom tear line 54B and fold line 32 should be significantly less than the diameter of a can to prevent cans from automatically rolling out of the carton when the dispenser opening B is opened. The dispenser B is designed to be used when the carton is resting on the end defined by bottom end flap 30, side end flap 38, top end flap 42 and side end flap 46. The dispenser ledge 66 between the bottom tear line 54B and fold line 32 can be moved forward by tearing along tear lines 64A and 64B. These tear lines are stopped from tearing by crease lines 78A and B respectively.

When the dispenser opening D' is used, blank 210 is used for the separator pad 214 so that the half trailing flap 212 does not interfere with the dispenser opening D' as shown in FIGS. 8 and 9. The dispenser opening D' is opened by placing the carton on a side panel 26 and punching in one or more of the finger opening flaps 72A–D and tearing tear lines 70A–D to remove end dispenser flaps 68A and 68B. It is also possible to start the tearing by tearing along starting slit 76. It will be noticed that tear lines 70A and 70B curve downwardly to meet each other where the bottom end flap 30 and the top end flap 42 meet. The distance between tear lines 70A and 70B and side panel 26 should be significantly less than the diameter of a can contained in the carton to prevent them from automatically rolling out of dispenser opening D' is open.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An article carrying carton with two ends loaded with a plurality of articles, comprising:

(a) said carton having a bottom panel, top panel and foldably attached adjoining side panels with at least one end being an interlocking end which is closed by a top end flap foldably attached to the top panel, a bottom end flap foldably attached to the bottom panel and a side end flap with an inside and outside which is foldably attached to each side panel, with each side end flap having an open-ended slit in an end remote from the side panel to which said side end flap is attached, with said end flaps being held together by closing means;

(b) two layers of articles with at least two rows of articles in each layer;

(c) an interlocking separator pad with two ends, of which at least one end is an interlocking end which is adjacent an interlocking end of the carton, said pad being located between the two layers of articles with each interlocking end of the pad having a single foldably attached leading flap with the leading flap extended through the slit in each side end flap on the interlocking end of the carton and interlocked with the side end flaps, with each interlocking end of the pad being folded in its entirety in a single direction such that the single leading flap is in a plane perpendicular to the bottom panel of the carton and being located on the outside of said side end flaps; and (d) means for closing the other end of the carton.

2. The carton loaded with a plurality of articles of claim 1, in which the means for closing the interlocking end of the carton is by gluing the top end flap and bottom end flap to the side end flaps, and the other end of the carton is closed by a top end flap foldably attached to the top panel and a bottom end flap foldably attached to the bottom panel and a side end flap foldably attached to each side panel, with the other end of the carton being closed by gluing the top end flap and bottom end flap to the side end flaps.

3. The carton loaded with a plurality of articles of claim 1, in which one end of the interlocking pad is an interlocking end and the other end has a foldably attached tailing flap which is located in a plane perpendicular to said pad and extends at least close to a panel of the carton that is parallel to said pad so as to better separate and support the articles in the carton.

4. The carton loaded with a plurality of articles of claim 1, in which both ends of the carton are interlocking ends with both ends of the interlocking separator pad being interlocking ends and in which the means for closing the interlocking ends of the carton is by gluing the top end flap and bottom end flap to the side end flaps.

5. The carton loaded with a plurality of articles of claim 3, in which the articles are generally cylindrical containers with two ends with an axis extending between the two ends, said axes of the containers being perpendicular to the separator pad.

6. The carton loaded with a plurality of articles of claim 4, in which the articles are generally cylindrical containers with two ends with an axis extending between the two ends, said axes of the containers being perpendicular to the separator pad.

7. The carton loaded with a plurality of articles of claim 5, said carton having a dispenser flap which when removed provides an opening which permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

8. The carton loaded with a plurality of articles of claim 7, in which said bottom tear line in the side panel of the carton is located from the closest side end flap by a distance which is sufficient to prevent a container adjacent the closest side end flap from rolling out of the opening formed when the dispenser flap is removed when the carton is resting on the end where said side end flap is located, but with said bottom tear line not being so far from said closest side end flap to prevent the removal through said opening of a container adjacent said closest side end flap.

9. The carton loaded with a plurality of articles of claim 8, in which the tear lines that extend into the adjoining bottom panel and adjoining top panel of the carton extend into each said panel far enough to permit a person to grasp the adjacent end of a container through the opening formed when the dispenser flap is removed.

10. The carton loaded with a plurality of articles of claim 9, in which a tear line interconnects said bottom tear line and top tear line in said side panel of the carton to facilitate opening said dispenser flap.

11. The carton loaded with a plurality of articles of claim 10, which has at least one finger flap in the dispenser flap adjacent to the tear line connecting the top and bottom tear lines together in said side panel to facilitate tearing the dispenser flap open.

12. The carton loaded with a plurality of articles of claim 11, which bas a tear line in the bottom panel between the bottom tear line and the closest bottom end flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

13. The carton loaded with a plurality of articles of claim 6, said carton having a dispenser flap which when removed provides an opening which permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

14. The carton loaded with a plurality of articles of claim 13, in which said bottom tear line in the side panel of the carton is located from the closest side end flap by a distance which in sufficient to prevent a container adjacent the closest side end flap from wiling out of the opening formed when the dispenser flap is removed when the carton is resting on the end where said side end flap is located, but with said bottom tear line not being so far from said closest side end flap to prevent the removal trough said opening of a container adjacent said closest side end flap.

15. The carton loaded with a plurality of articles of claim 14, in which the tear lines that extend into the adjoining bottom panel and adjoining top panel of the carton extend into each said panel far enough to permit a person to grasp the adjacent end of a container through the opening formed when the dispenser flap is removed.

16. The carton loaded with a plurality of articles of claim 15, in which a tear line interconnects said bottom tear line and top tear line in said side panel of the carton to facilitate opening said dispenser flap.

17. The carton loaded with a plurality of articles of claim 16, which has at least one finger flap in the dispenser flap adjacent to the tear line connecting the top and bottom tear lines together in said side panel to facilitate tearing the dispenser flap open.

18. The carton loaded with a plurality of articles of claim 17, which has a tear line in the bottom panel between the bottom tear line and the closest bottom end flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

19. The carton loaded with a plurality of articles of claim 5, which carton has a dispenser flap in one end of the carton which when removed creates an opening which permits the removal of containers from each layer, said dispenser flap being formed by a tear line that extends through the bottom end flap to the bottom panel and turns toward the side panel upon which the carton is designed to rest when dispensing containers, said tear line extending to said side panel, said tear line also extending through the top end flap to the top panel and turns towards said side panel, said tear line extending to said side panel, with said tear line in the bottom end flap and top end flap being located at a sufficient distance from said side panel to permit containers to be removed from each layer but not so far from said side panel as to allow containers to automatically roll out of the opening when the dispenser flap is removed.

20. The carton loaded with a plurality of articles of claim 6, which carton has a dispenser flap in one end of the carton which when removed creates an opening which permits the removal of containers from each layer, said dispenser flap being formed by a tear line that extends through the bottom end flap to the bottom panel and turns toward the side panel upon which the carton is designed to rest when dispensing containers, said tear line extending to said side panel, said tear line also extending through the top end flap to the top panel and turns towards said side panel, said tear line extending to said side panel, with said tear line in the bottom end flap and top end flap being located at a sufficient distance from said side panel to permit containers to be removed from each layer but not so far from said side panel as to allow containers to automatically roll out of the opening when the dispenser flap is removed.

21. The carton loaded with a plurality of articles of claim 19, in which the tear line in the bottom end flap curves downwardly from the bottom panel towards the side panel upon the carton is designed to rest when dispensing containers until it meets the tear line in the top end flap which extends upwardly to the top panel, said curve in the tear line providing resistance to the containers automatically rolling out of the opening when the dispenser flap is removed.

22. The carton loaded with a plurality of articles of claim 21, in which at least one finger flap is located adjacent the dispenser flap to facilitate the removal of the dispenser flap.

23. The carton loaded with a plurality of articles of claim 19, in which the dispenser is located in the end of the carton where the trailing flap of the interlocking separator pad is located, with the tailing flap not extending into the opening formed when the dispenser flap is removed so as to impede the removal of containers from the opening.

24. A carton with two ends for carrying a plurality of generally cylindrical containers in two layers with at least two rows in each layer and an interlocking separator pad for keeping the layers of containers separate, comprising:

(a) a carton having a bottom panel top panel and foldably attached adjoining side panels with one end of the carton being an interlocking end, with each end of carton being closed by a top end flap foldably attached to the top panel, a bottom end flap foldably attached to the bottom panel and a side end flap which is foldably attached to each side panel, with each side end flap having an end remote from the side panel to which said side end flap is attached, with each remote end on the side end flaps on the interlocking end of the carton having an open-ended slit, with each end of the carton having been closed by gluing the top end flap and bottom end flap to the side end flaps on that end of the carton; and (b) an interlocking separator pad with two ends, of which at least one end is an interlocking end which has a single foldably attached leading flap, said leading flap extending through the slits in the side end flaps on the interlocking end of the carton and interlocked, with the leading flap folded into a plane generally perpendicular to the bottom panel of the carton in a single direction, said pad having a foldably attached trailing flap which is folded into a plane generally perpendicular to the bottom panel of the carton and extending at least close to a panel of the carton that is parallel to said pad so as to better separate and support the containers to be carried in the carton.

25. A carton with two ends for carrying a plurality of generally cylindrical containers in two layers with at least two rows in each layer and an interlocking separator pad for keeping the layers of containers separate, comprising:

(a) a carton having a bottom panel, top panel and foldably attached adjoining side panels, with each end of the carton being an interlocking end, with each end of the carton being closed by a top end flap foldably attached to the top panel, a bottom end flap foldably attached to the bottom panel and a side end flap which is foldably attached to each side panel, with each side end flap having an end remote from the side end panel to which said side end flap is attached, with each remote end on each side end flap on each end of the carton having an open-ended slit, with each end of the carton having been closed by gluing the top end flap and bottom end flap to the side end flaps on tat end of the carton; and (b) an interlocking separator pad with two ends, each of which is an interlocking end which has a single foldably attached leading flap, with each said leading flap extending through the slits in the side end flaps on an end of the carton, with each leading flap folded in a single direction into a plane generally perpendicular to the pad.

26. The carton and interlocking separator pad of claim 24, for carrying a plurality of containers with each container having a diameter, said carton having a dispenser flap which when removed provides an opening which permits the removal of the containers from each layer, said dispenser flap fanned by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

27. The carton and interlocking separator pad of claim 26, in which said bottom tear line in the side panel of the carton is located from the closest side end flap by a distance which is sufficient to prevent any container in the carton adjacent to the closest side end flap from rolling out of the opening formed when the dispenser flap is removed when the carton is resting on the end where said side end flap is located, but with said bottom tear line not being so far from said closest side end flap to prevent the removal through said opening of a container adjacent said closest side end flap.

28. The carton and interlocking separator pad of claim 27, in which the tear lines that extend into the adjoining bottom panel and adjoining top panel of the carton extend into each said panel far enough to permit a person to grasp the adjacent end of a container through the opening formed when the dispenser flap is removed.

29. The carton and interlocking separator pad of claim 28, in which a tear line interconnects said bottom tear line and top tear line in said side panel of the carton to facilitate opening said dispenser flap.

30. The carton and interlocking separator pad of claim 29, which has at least one finger flap in the dispenser flap adjacent to the tear line connecting the top and bottom tear lines together in said side panel to facilitate tearing the dispenser flap open.

31. The carton and interlocking separator pad of claim 30, which has a tear line in the bottom panel between the bottom tear line and the closest bottom flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

32. The carton and interlocking separator pad of claim 24, which carton has a dispenser flap in one end of the carton which when removed creates an opening which permits the removal of containers from each layer, said dispenser flap being formed by a tear line that extends through the bottom end flap to the bottom panel and turns toward the side panel upon which the carton is designed to rest when dispensing containers, said tear line extending to said side panel, said tear line also extending through the top end flap to the top panel and turns towards said side panel, said tear line extending to said side panel, with said tear line in the bottom end flap and top end flap being located at a sufficient distance from said side panel to permit containers to be removed from each layer, but not so far from said side panel as to allow containers to automatically roll out of the opening when the dispenser flap is removed, with said trailing flap not extending into the opening formed when the dispenser flap is removed.

33. The carton and interlocking separator pad of claim 25, which carton has a dispenser flap in one end of the carton which when removed creates an opening which permits the removal of containers from each layer, said dispenser flap being formed by a tear line that extends through the bottom end flap to the bottom panel and turns toward the side panel upon which the carton is designed to rest when dispensing containers, said tear line extending to said side panel, said tear line also extending through the top end flap to the top panel and turns towards said side panel, said tear line extending to said side panel, with said tear line in the bottom end flap and top end flap being located at a sufficient distance from said side panel to permit containers to be removed from each layer, but not so far from said side panel as to allow containers to automatically roll out of the opening when the dispenser flap is removed.

34. A blank for a carton with two ends for carrying a plurality of generally cylindrical containers in two layers with at least two rows in each layer and an interlocking separator pad for keeping the layers of containers separated, comprising:

(a) said carton blank having a bottom panel, top panel and foldably attached adjoining side panel, with one end of the carton being an interlocking end, with each end of the carton being closed by a top end flap foldably attached to the top panel, a bottom end flap foldably attached to the bottom panel and a side end flap which is foldably attached to each side panel, with each side end flap on the interlocking end of the carton having a remote end which has an open-ended slit, with each end being designed to be closed by gluing the top end flap and bottom end flap to the side end flaps on that end of the carton; and (b) an interlocking separator pad with two ends, at least one of which is an interlocking end which has a single foldably attached leading flap, said leading flap being designed to be inserted through the slits in the side end flaps on the interlocking end of the carton and interlocked, with the leading flap being designed to be folded into a plane perpendicular to the bottom panel of the carton a single direction, said pad having a foldably attached trailing flap which is designed to be folded into a plane perpendicular to the bottom panel of the carton and to extend at least close to a panel of the carton that is parallel to said pad so as to better separate and support the containers to be carried in the carton.

35. A blank for a carton with two ends for carrying a plurality of generally cylindrical containers in two layers with at least two rows in each layer and an interlocking separator pad for keeping the layers of containers separated, comprising:

(a) said carton blank having a bottom panel, top panel and foldably attached adjoining side panel, with both ends of the carton being interlocking ends, with each end of the carton being closed by a top end flap foldably attached to the top panel, a bottom end flap foldably attached to the bottom panel and the side end flap which is foldably attached to each side panel, with each side end flap having a remote end which has an open-ended slit with each end being designed to be closed by gluing the top end flap and bottom end flap to the side end flap on that end of the carton; and (b) an interlocking separator pad with two ends with each end being an interlocking end which has a single foldably attached leading flap, said leading flap being designed to be inserted through the slits in the side end flaps on an end of the carton and interlocked, with each leading flap being designed to be folded into plane perpendicular to the bottom panel of a carton in a single direction.

36. A blank for a carton with two ends for carrying a plurality of generally cylindrical containers in two layers with two rows in each layer and interlocking separator pad for keeping the layers of containers separate, comprising:

(a) a carton having a bottom panel, top panel and foldably attached adjoining side panels with one end of the carton being an interlocking end, with each end of carton being closed by a top end flap foldably attached to the top panel, a bottom end flap foldably attached to the bottom panel and a side end flap which is foldably attached to each side panel, with each side end flap on the interlocking end of the carton having an end remote from the side panel to which said side end flap is attached, with each remote end having an open-ended slit, with each end of the carton secured in the closed position by the top end flap and bottom end flap being designed to be closed by gluing to the side end flaps on each end of the carton; and (b) an interlocking separator pad with two ends, with one end being an interlocking end which has a single foldably attached leading flap, with the leading flap designed to be inserted through the slits in the side end flaps on the interlocking end of the carton, with the leading flap being designed to be folded into a plane perpendicular to the bottom panel of the carton in a single direction and lodged between the side end flaps on the interlocking end of the carton and the bottom end flap and top end flap, said pad having a foldably attached trailing flap on the other end of the pad being designed to be folded into a plane perpendicular to the bottom panel of the carton with said trailing flap extending close to a panel of the carton that is parallel to said pad so as to better separate and support the containers to be cried in the carton.

37. An article carrying carton with two ends loaded with a plurality of articles, comprising:

a carton, comprising:

a bottom panel;

a top panel;

a first side panel;

a second side panel;

a first top end flap;

a first bottom end flap;

a first side end flap foldably attached to the first side panel, the first side end flap having a first open-ended slit;

a second side end flap foldably attached to the second side panel;

wherein the first top end flap, the first bottom end flap, the first side end flap and the second side end flap extend across a first end of the carton; and a plurality of second end flaps extending across a second end of the carton;

two layers of articles with at least two rows of articles in each layer; and an interlocking separator pad located between the two layers of articles, the interlocking separator pad having a first end with a first single foldably attached leading flap, wherein the first leading flap extends through the first open-ended slit in the first side end flap and being folded in its entirety in a single direction such that the single leading flap is in a plane generally perpendicular to the bottom panel and located outside of the first and second side end flaps.

38. The carton and plurality of articles of claim 37, wherein the second side end flap has a second open-ended slit, the first leading flap extending through the second open-ended slit.

39. The carton and plurality of articles of claim 37, wherein the first top end flap and the first bottom end flap are glued to the first and second side end flaps.

40. The carton and plurality of articles of claim 37, wherein the first leading flap is located inside of the first top end flap.

41. The carton and plurality of articles of claim 40, wherein a second end of the separator pad comprises a trailing flap located in a plane generally perpendicular to the bottom panel and extends adjacent to either the top or bottom panel.

42. The carton and plurality of articles of claim 37, the carton having at least one dispenser flap which when removed provides an opening which permits removal of the containers from the carton.

43. The carton and plurality of articles of claim 37, wherein the articles are generally cylindrical containers with two ends with an axis extending between the two ends, the axes of the containers being generally perpendicular to the separator pad.

* * * * *